US009482446B2

(12) United States Patent
Nomoto et al.

(10) Patent No.: US 9,482,446 B2
(45) Date of Patent: Nov. 1, 2016

(54) HEAT PUMP WATER HEATER

(71) Applicant: Mitsubishi Electric Corporation, Tokyo (JP)

(72) Inventors: So Nomoto, Tokyo (JP); Kensaku Hatanaka, Tokyo (JP); Keisuke Takayama, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 71 days.

(21) Appl. No.: 14/425,652

(22) PCT Filed: Jul. 23, 2013

(86) PCT No.: PCT/JP2013/069924

§ 371 (c)(1),
(2) Date: Mar. 4, 2015

(87) PCT Pub. No.: WO2014/050274

PCT Pub. Date: Apr. 3, 2014

(65) Prior Publication Data

US 2015/0226453 A1 Aug. 13, 2015

(30) Foreign Application Priority Data

Sep. 25, 2012 (JP) ..... 2012-210728

(51) Int. Cl.
*F24H 4/04* (2006.01)
*F24D 19/00* (2006.01)
(Continued)

(52) U.S. Cl.
CPC ..... *F24H 4/04* (2013.01); *F24D 19/0092* (2013.01); *F25B 31/006* (2013.01); *F25B 40/00* (2013.01); *F25B 2339/047* (2013.01)

(58) Field of Classification Search
CPC .... F24H 4/04; F24D 19/0092; F25B 31/006; F25B 6/04; F25B 2339/047; F25B 40/00
USPC ..... 62/238.7, 506
See application file for complete search history.

(56) References Cited

U.S. PATENT DOCUMENTS 4,321,797 A * 3/1982 Yaeger ..... F24D 17/02 62/238.6
6,827,091 B2 * 12/2004 Harrison ..... F24D 3/08 134/105

(Continued)

FOREIGN PATENT DOCUMENTS

JP 2004-144445 A 5/2004
JP 2006-132427 A 5/2006

(Continued)

OTHER PUBLICATIONS

International Search Report of the International Searching Authority mailed Oct. 8, 2013 for the corresponding international application No. PCT/JP2013/069924 (and English translation).

(Continued)

*Primary Examiner* — Mohammad M Ali
(74) *Attorney, Agent, or Firm* — Posz Law Group, PLC

(57) ABSTRACT

A heat pump water heater includes: a compressor; a first water-refrigerant heat exchanger; a second water-refrigerant heat exchanger; refrigerant paths capable of forming a refrigerant circuit; and water channels including a flow channel, the flow channel leading hot water that has passed through the second water-refrigerant heat exchanger to the first water-refrigerant heat exchanger. The heat pump water heater is able to perform a heating operation. In the heating operation, the hot water heated in the second water-refrigerant heat exchanger is fed to the first water-refrigerant heat exchanger and the hot water further heated in the first water-refrigerant heat exchanger is supplied to a downstream side of the water channels. The first water-refrigerant heat exchanger is able to be replaced without replacing the second water-refrigerant heat exchanger.

27 Claims, 4 Drawing Sheets

(51) Int. Cl.
*F25B 31/00* (2006.01)
*F25B 40/00* (2006.01)

(56) References Cited

U.S. PATENT DOCUMENTS

2001/0048031 A1* 12/2001 Noro ..... F24H 4/04 237/2 B
2008/0041071 A1* 2/2008 Itoh ..... B60H 1/00342 62/79
2010/0117843 A1* 5/2010 Kobayashi ..... F24D 17/02 340/622
2010/0282435 A1* 11/2010 Yabuuchi ..... F24D 17/0073 165/63
2011/0197600 A1* 8/2011 Hamada ..... F24H 4/04 62/79
2011/0214444 A1* 9/2011 Yoshii ..... F24H 4/04 62/160
2012/0047930 A1* 3/2012 Uselton ..... F24D 11/0242 62/176.6
2012/0060538 A1* 3/2012 Saito ..... F24H 4/02 62/324.1

FOREIGN PATENT DOCUMENTS

JP 2009-145007 A 7/2009
JP 2011-137622 A 7/2011
JP 2011-149631 A 8/2011
JP 2011-252677 A 12/2011

OTHER PUBLICATIONS

International Preliminary Report on Patentability issued on Mar. 31, 2015 for the corresponding international application No. PCT/JP2013/069924 (with English translation).

* cited by examiner

HEAT PUMP WATER HEATER

CROSS REFERENCE TO RELATED APPLICATIONS

This application is a U.S. national stage application of International Application No. PCT/JP2013/069924 filed on Jul. 23, 2013, and is based on Japanese Patent Application No. 2012-210728 filed on Sep. 25, 2012, the disclosures of which are incorporated by reference.

TECHNICAL FIELD

The present invention relates to a heat pump water heater.

BACKGROUND ART

Heat pump-type hot water supply devices that heat water by means of a refrigerant in a refrigeration cycle to produce hot water have widely been used. The heat pump water heaters each include a water-refrigerant heat exchanger that heats water to provide hot water by means of heat exchange between a high-temperature refrigerant and the water. Solids generally called scale adhere to the inner wall of a water flow path inside the water-refrigerant heat exchanger. The scale is mainly formed as a result of deposition of precipitated calcium solute in the water. As the water temperature is higher, the solubility of calcium is lower. Thus, in the case of water having a high calcium hardness, during the process of heating water in the water-refrigerant heat exchanger, calcium carbonate precipitates and scale is thereby generated. If the flow path is narrowed as a result of accumulation of the scale, the flow path resistance becomes large and the water flow rate is thus lowered, causing an adverse effect on the operation of the heat pump water heater.

Patent Literature 1 discloses a heat pump water heater including: water flow rate detecting means for detecting a water flow rate of a hot water supply circuit in order to detect an abnormality of a water circuit due to, e.g., accumulation of scale; and water circuit abnormality detecting means for driving a pump at a predetermined rotation speed, detecting the water flow rate via the water flow rate detecting means, and if the water flow rate is smaller than a water flow rate set in advance, determines that a water circuit abnormality occurs.

CITATION LIST

Patent Literature

Patent literature 1: Japanese Patent Laid-Open No. 2009-145007

SUMMARY OF INVENTION

Technical Problem

When the water flow path is further narrowed due to the accumulation of scale in the water-refrigerant heat exchanger, a countermeasure such as replacing a water-refrigerant heat exchanger with a new one may be taken. However, in a general heat pump water heater, a water-refrigerant heat exchanger is installed in a lower portion of an ventilation chamber in such a manner that the water-refrigerant heat exchanger is covered by a heat-insulating material and further housed in a hard case. Furthermore, a fan is fixed at a position above the water-refrigerant heat exchanger in the case that houses the water-refrigerant heat exchanger. With such structure, it is not easy to remove the water-refrigerant heat exchanger, and in reality, the water-refrigerant heat exchanger is rarely replaced, and the method of replacing the entire heat pump unit is taken. Thus, the problem of a large cost for maintenance occurs.

The present invention has been made in order to solve problems such as stated above, and an object of the present invention is to provide a heat pump water heater that enables easy and low-cost maintenance for a case where deposits precipitated from hot water are accumulated in a water-refrigerant heat exchanger.

Solution to Problem

A heat pump water heater of the invention comprises: a compressor configured to compress a refrigerant; a first water-refrigerant heat exchanger configured to exchange heat between the refrigerant and water; a second water-refrigerant heat exchanger configured to exchange heat between the refrigerant and water; refrigerant paths capable of forming a refrigerant circuit, the refrigerant circuit supplying the refrigerant compressed by the compressor to the first water-refrigerant heat exchanger, the refrigerant circuit supplying the refrigerant that has passed through the first water-refrigerant heat exchanger to the second water-refrigerant heat exchanger; and water channels including a flow channel, the flow channel leading hot water that has passed through the second water-refrigerant heat exchanger to the first water-refrigerant heat exchanger. The heat pump water heater is able to perform a heating operation. In the heating operation, the hot water heated in the second water-refrigerant heat exchanger is fed to the first water-refrigerant heat exchanger and the hot water further heated in the first water-refrigerant heat exchanger is supplied to a downstream side of the water channels. The first water-refrigerant heat exchanger is able to be replaced without replacing the second water-refrigerant heat exchanger.

Advantageous Effects of Invention

The present invention enables provision of a countermeasure for accumulation of deposits precipitated from hot water by replacing a first water-refrigerant heat exchanger with a large amount of deposits without replacing a second water-refrigerant heat exchanger with a small amount of deposits. Thus, the present invention enables easy and low-cost maintenance.

DESCRIPTION OF EMBODIMENT

Figure 1:
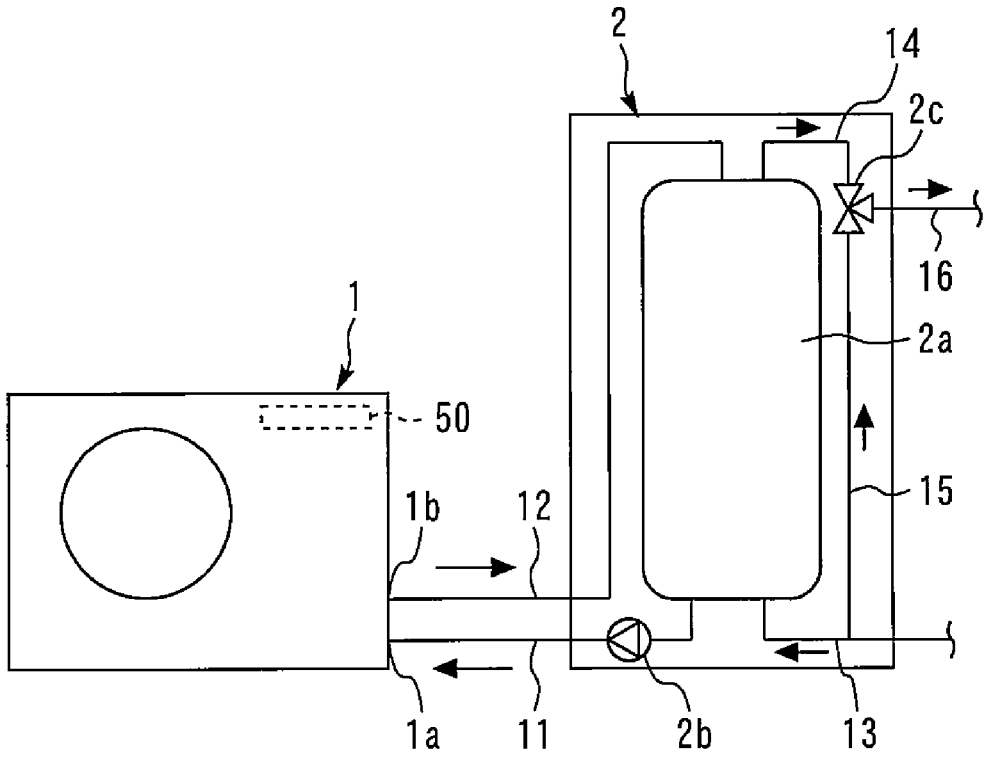
FIG. 1 is a configuration diagram illustrating a heat pump water heater according to Embodiment 1 of the present invention.

Now, with reference to the drawings, embodiments of the present invention will be described. In the drawings, common components are denoted by the same reference numerals, and overlapping descriptions will be omitted.

Embodiment 1

FIG. 1 is a configuration diagram illustrating a heat pump water heater according to Embodiment 1 of the present invention. As illustrated in FIG. 1, the heat pump water heater according to the present embodiment includes a heat pump unit 1 and a tank unit 2. Inside the tank unit 2, a hot water storage tank 2*a* that stores water, and a water pump 2*b* are installed. The heat pump unit 1 and the tank unit 2 are connected via a water pipe 11 and a water pipe 12, and a non-illustrated electric wiring. An end of the water pipe 11 is connected to a water entrance port 1*a* of the heat pump unit 1. Another end of the water pipe 11 is connected to a lower portion of the hot water storage tank 2*a* inside the tank unit 2. At a position partway along the water pipe 11 inside the tank unit 2, a water pump 2*b* is installed. An end of the water pipe 12 is connected to a hot water exit port 1*b* of the heat pump unit 1. Another end of the water pipe 12 is connected to an upper portion of the hot water storage tank 2*a* inside the tank unit 2. Instead of the illustrated configuration, the water pump 2*b* may be disposed inside the heat pump unit 1.

A feed-water pipe 13 is further connected to the lower portion of the hot water storage tank 2*a*. Water supplied from an external water source such as a waterworks system passes through the feed-water pipe 13, and flows into, and is stored in, the hot water storage tank 2*a*. The inside of the hot water storage tank 2*a* is consistently maintained full with water. Inside the tank unit 2, a hot water supply mixing valve 2*c* is further provided. The hot water supply mixing valve 2*c* is connected to the upper portion of the hot water storage tank 2*a* via a hot water outflow pipe 14. Also, a water supply branch pipe 15, which branches from the feed-water pipe 13, is connected to the hot water supply mixing valve 2*c*. Furthermore, an end of a hot water supply pipe 16 is further connected to the hot water supply mixing valve 2*c*. Another end of the hot water supply pipe 16 is connected to a hot water supply terminal such as a faucet, a shower or a bathtub, for example, though not illustrated.

When heating water stored in the hot water storage tank 2*a*, a heating operation of actuating the heat pump unit 1 and the water pump 2*b* is performed. In the heating operation, the water stored in the hot water storage tank 2*a* is sent by the water pump 2*b* to the heat pump unit 1 through the water pipe 11, and is heated inside the heat pump unit 1 and thereby becomes high-temperature hot water. The high-temperature hot water produced inside the heat pump unit 1 returns to the tank unit 2 through the water pipe 12 and flows into the hot water storage tank 2*a* from the upper portion. As a result of such heating operation, water are stored in the hot water storage tank 2*a* in such a manner that high-temperature hot water is stored on the upper side and the low-temperature water is stored on the lower side.

When supplying hot water from the hot water supply pipe 16 to the hot water supply terminal, the high-temperature hot water in the hot water storage tank 2*a* is supplied to the hot water supply mixing valve 2*c* through the hot water outflow pipe 14 and the low-temperature water is supplied to the hot water supply mixing valve 2*c* through the water supply branch pipe 15. The high-temperature hot water and the low-temperature water are mixed at the hot water supply mixing valve 2*c* and supplied to the hot water supply terminal through the hot water supply pipe 16. The hot water supply mixing valve 2*c* has a function that adjusts a mixing ratio between high-temperature hot water and low-temperature water so as to achieve a hot water temperature set by a user.

The present heat pump water heater includes a controller 50. The controller 50 are electrically connected to each of actuators and the like, sensors and the like (not illustrated) and an user interface device (not illustrated) included in the present heat pump water heater, and functions as control means for controlling the present heat pump water heater. Although in FIG. 1, the controller 50 is installed inside the heat pump unit 1, a site where the controller 50 is installed is not limited to the inside of the heat pump unit 1. The controller 50 may be installed inside the tank unit 2. Also, a configuration in which the controller 50 is separated into parts and the parts are disposed inside the heat pump unit 1 and the tank unit 2, respectively, and are connected in such a manner that the parts can communicate with each other may be provided.

Figure 2:
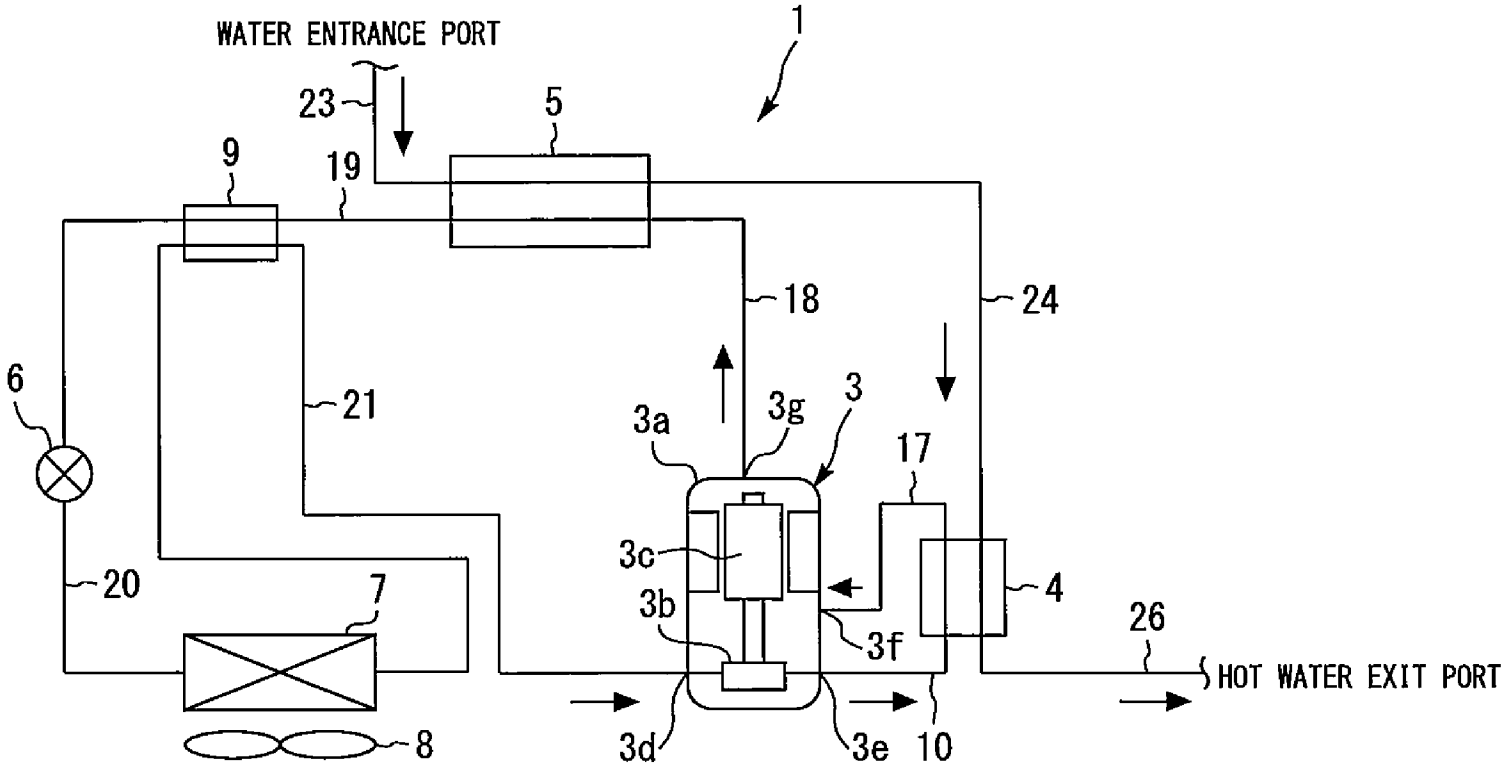
FIG. 2 is a diagram schematically illustrating a configuration of a refrigerant circuit and water channels included in the heat pump unit of the heat pump water heater according to Embodiment 1 of the present invention.

FIG. 2 is a diagram schematically illustrating a configuration of a refrigerant circuit and water channels included in the heat pump unit 1. As illustrated in FIG. 2, the heat pump unit 1 includes a refrigerant circuit including the compressor 3, the first water-refrigerant heat exchanger 4, the second water-refrigerant heat exchanger 5, an expansion valve 6 and an evaporator 7, and a water channel that leads water to the first water-refrigerant heat exchanger 4 and the second water-refrigerant heat exchanger 5. The evaporator 7 in the present embodiment includes an air-refrigerant heat exchanger that exchanges heat between air and the refrigerant. Also, the heat pump unit 1 according to the present embodiment further includes a blower 8 that blows air into the evaporator 7, and a high-low pressure heat exchanger 9 that exchanges heat between a high pressure-side refrigerant and a low pressure-side refrigerant. The compressor 3, the first water-refrigerant heat exchanger 4, the second water-refrigerant heat exchanger 5, the expansion valve 6, the evaporator 7 and the high-low pressure heat exchanger 9 are connected via refrigerant pipes, which serves as refrigerant paths, forming a refrigerant circuit.

In the heating operation, the heat pump unit 1 actuates the compressor 3 to operate a refrigeration cycle. The compressor 3 in the present embodiment includes a sealed container 3*a*, a compression element 3*b* and a motor element 3*c* provided inside the sealed container 3*a*, a first inlet 3*d*, a first outlet 3*e*, a second inlet 3*f* and a second outlet 3*g*. A refrigerant drawn in from the first inlet 3*d* flows into the compression element 3*b*. The compression element 3*b* is driven by the motor element 3*c* and thereby compresses the refrigerant. The refrigerant compressed by the compression element 3*b* is discharged from the first outlet 3*e*. The refrigerant discharged from the first outlet 3*e* flows into the first water-refrigerant heat exchanger 4 through a refrigerant path 10. The refrigerant that has passed through the first water-refrigerant heat exchanger 4 flows into the second inlet 3*f* through a refrigerant path 17. The refrigerant that has flown into the sealed container 3*a* of the compressor 3 from the second inlet 3*f* passes, e.g., between a rotor and a stator of the motor element 3*c* and thereby cools the motor element 3*c*, and is then discharged from the second outlet 3*g*. The refrigerant discharged from the second outlet 3*g* flows into the second water-refrigerant heat exchanger 5 through a refrigerant path 18. The refrigerant that has passed through the second water-refrigerant heat exchanger 5 flows into the expansion valve 6 through a refrigerant path 19. The refrigerant that has passed through the expansion valve 6 flows into the evaporator 7 through a refrigerant path 20. The refrigerant that has passed through the evaporator 7 is drawn into the compressor 3 from the first inlet 3*d* through a refrigerant path 21. The high-low pressure heat exchanger 9 exchanges heat between the high-pressure refrigerant passing through the refrigerant path 19 and the low-pressure refrigerant passing through the refrigerant path 21.

The heat pump unit 1 further includes a water channel 23 connecting the water entrance port 1*a* and an entrance of the second water-refrigerant heat exchanger 5, a water channel 24 connecting an exit of the second water-refrigerant heat exchanger 5 and an entrance of the first water-refrigerant heat exchanger 4, and a water channel 26 connecting an exit of the first water-refrigerant heat exchanger 4 and the hot water exit port 1*b*. In the heating operation, water that has flown in from the water entrance port 1*a* flows into the second water-refrigerant heat exchanger 5 through the water channel 23 and is then heated by heat of the refrigerant inside the second water-refrigerant heat exchanger 5. Hot water produced as a result of the heating inside the second water-refrigerant heat exchanger 5 flows into the first water-refrigerant heat exchanger 4 through the water channel 24, and is then further heated by heat of the refrigerant inside the first water-refrigerant heat exchanger 4. The hot water having a further increased temperature as a result of the heating inside the first water-refrigerant heat exchanger 4 reaches the hot water exit port 1*b* through the water channel 26, and is then supplied to the tank unit 2 through the water pipe 12.

For the refrigerant, a refrigerant that enables a high-temperature hot water outflow, for example, a refrigerant such as carbon dioxide, R410A, propane or propylene is suitable, but the refrigerant is not specifically limited to the above examples.

The high-temperature, high-pressure gas refrigerant discharged from the first outlet 3*e* of the compressor 3 dissipates heat while passing through the first water-refrigerant heat exchanger 4, whereby a temperature of the refrigerant decreases. In the present embodiment, the refrigerant whose temperature has decreased during the passage through the first water-refrigerant heat exchanger 4 flows into the sealed container 3*a* from the second inlet 3*f* and cools the motor element 3*c*, whereby a temperature of the motor element 3*c* and a surface temperature of the sealed container 3*a* can be decreased. As a result, a motor efficiency of the motor element 3*c* can be enhanced, and loss of heat due to dissipation from the surface of the sealed container 3*a* can be reduced. The refrigerant conducts heat away from the motor element 3*c* and thereby increases the temperature thereof and then flows into the second water-refrigerant heat exchanger 5, and dissipates heat while passing through the second water-refrigerant heat exchanger 5, whereby the temperature decreases. The high-pressure refrigerant with the decreased temperature heats the low-pressure refrigerant while passing through the high-low pressure heat exchanger 9 and then passes through the expansion valve 6. As a result of the passage through the expansion valve 6, the pressure of the refrigerant is reduced so that the refrigerant is brought into a low-pressure gas-liquid two-phase state. The refrigerant that has passed through the expansion valve 6 absorbs heat from external air while passing through the evaporator 7, and evaporates and gasifies. The low-pressure refrigerant that has exited from the evaporator 7 is heated in the high-low pressure heat exchanger 9 and then drawn into the compressor 3 and is circulated.

If the pressure of the high pressure-side refrigerant is equal to or exceeds a critical pressure, the refrigerant in the first water-refrigerant heat exchanger 4 and the second water-refrigerant heat exchanger 5 decreases in temperature and dissipates heat as the refrigerant remains in a supercritical state without gas-liquid phase transition. Also, if the pressure of the high pressure-side refrigerant is equal to or below the critical pressure, the refrigerant dissipates heat while liquefying. In the present embodiment, it is preferable to use, e.g., carbon dioxide as the refrigerant to make the pressure of the high pressure-side refrigerant be equal to or exceed the critical pressure. If the pressure of the high pressure-side refrigerant is equal to or exceeds the critical pressure, no liquefied refrigerant flows into the sealed container 3*a* from the second inlet 3*f* and also no liquefied refrigerant adheres to the motor element 3*c*, enabling reduction in rotation resistance of the motor element 3*c*. Furthermore, no liquefied refrigerant flows into the sealed container 3*a* from the second inlet 3*f*, providing the advantage of preventing a refrigerant oil from being diluted by the refrigerant.

In the heating operation, the controller 50 performs controls so that a temperature of hot water supplied from the heat pump unit 1 to the tank unit 2 (hereinafter referred to as "hot water outflow temperature") becomes a target hot water outflow temperature. The target hot water outflow temperature is set at, for example, 65° C. to 90° C. In the present embodiment, the controller 50 controls the hot water outflow temperature by adjusting a rotation speed of the water pump 2*b*. The controller 50 detects the hot water outflow temperature via a temperature sensor (not illustrated) provided in the water channel 26, and if the detected hot water outflow temperature is higher than the target hot water outflow temperature, corrects the rotation speed of the water pump 2*b* so as to increase the rotation speed, and if the hot water outflow temperature is lower than the target hot water outflow temperature, corrects the rotation speed of the water pump 2*b* so as to decrease the rotation speed. Consequently, the controller 50 can perform control so that the hot water outflow temperature corresponds to the target hot water outflow temperature. However, in the present invention, the hot water outflow temperature may be controlled by controlling, e.g., the temperature of the refrigerant discharged from the first outlet 3*e* of the compressor 3 or the rotation speed of the compressor 3.

Figure 3:
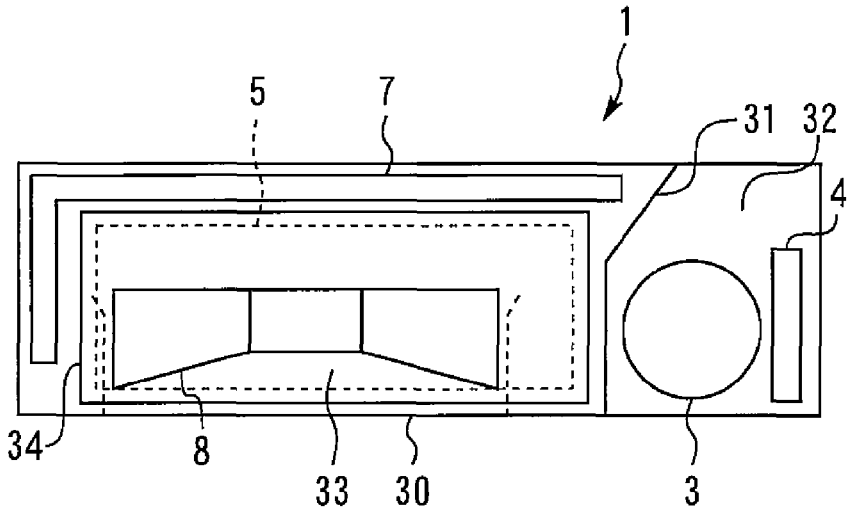
FIG. 3 is a transparent plan view of the heat pump unit of the heat pump water heater according to Embodiment 1 of the present invention.
Figure 4:
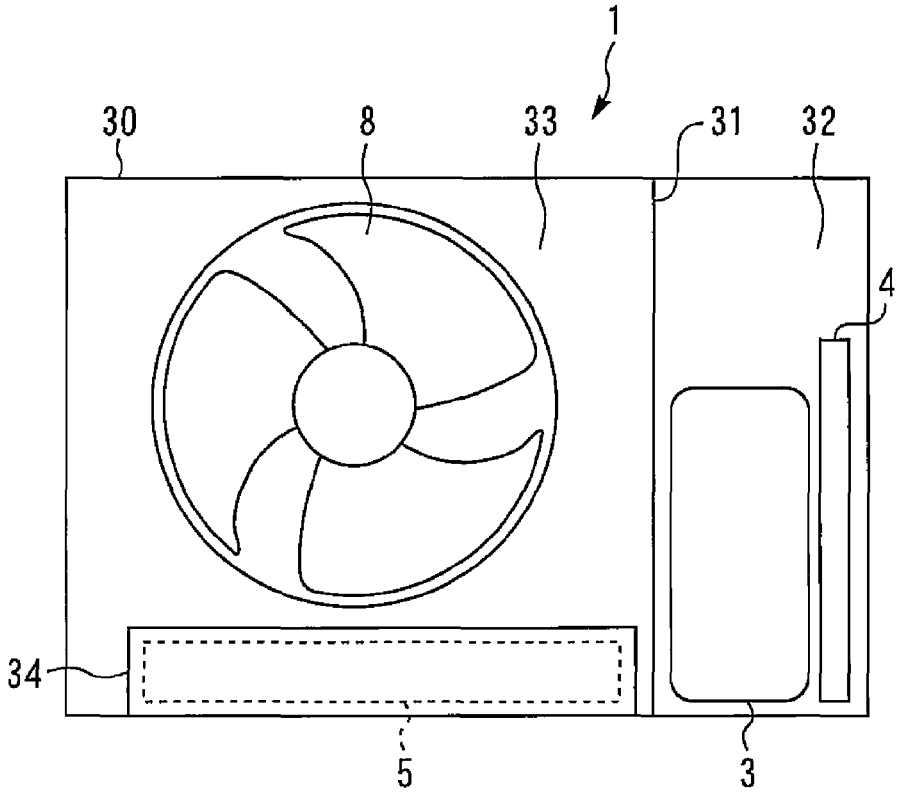
FIG. 4 is a transparent front view of the heat pump unit of the heat pump water heater according to Embodiment 1 of the present invention.

FIG. 3 is a transparent plan view of the heat pump unit 1. FIG. 4 is a transparent front view of the heat pump unit 1. In FIGS. 3 and 4, illustration of, e.g., the expansion valve 6, the high-low pressure heat exchanger 9, and pipes forming the refrigerant paths and the water channels is omitted. As illustrated in these Figures, the heat pump unit 1 includes a housing 30 that houses the components. Inside the housing 30, a partition member 31 is provided. The inside of the housing 30 is partitioned by the partition member 31, whereby a plurality of chambers is formed. In the present embodiment, a machine chamber 32 and an ventilation chamber 33 are formed inside the housing 30. Inside the machine chamber 32, the compressor 3 and the first water-refrigerant heat exchanger 4 are installed. The first water-refrigerant heat exchanger 4 is disposed upright side by side with the compressor 3. The first water-refrigerant heat exchanger 4 is preferably covered by a non-illustrated heat insulating material.

In the ventilation chamber 33, the second water-refrigerant heat exchanger 5, the evaporator 7 and the blower 8 are installed. The second water-refrigerant heat exchanger 5 is housed in a waterproof hard casing 34 made from metal, and is covered by a heat insulating material (not illustrated) inside the casing 34. The casing 34 is installed in a lower portion of the inside of the ventilation chamber 33. The blower 8 is installed above the casing 34. The evaporator 7, which has a rough L-shape in plan view, is disposed so as to cover a back surface, and one of side surfaces, of the ventilation chamber 33. Upon actuation of the blower 8, external air is drawn into the ventilation chamber 33 and flows through the evaporator 7.

In the present embodiment, the second water-refrigerant heat exchanger 5 is installed inside the ventilation chamber 33 though which external air flows, and thus, it is necessary to house the second water-refrigerant heat exchanger 5 in the casing 34 to protect the second water-refrigerant heat exchanger 5. On the other hand, the first water-refrigerant heat exchanger 4 is installed inside the machine chamber 32 through which no external air flows, there is no problem in the first water-refrigerant heat exchanger 4 being not housed in a container.

Figure 5:
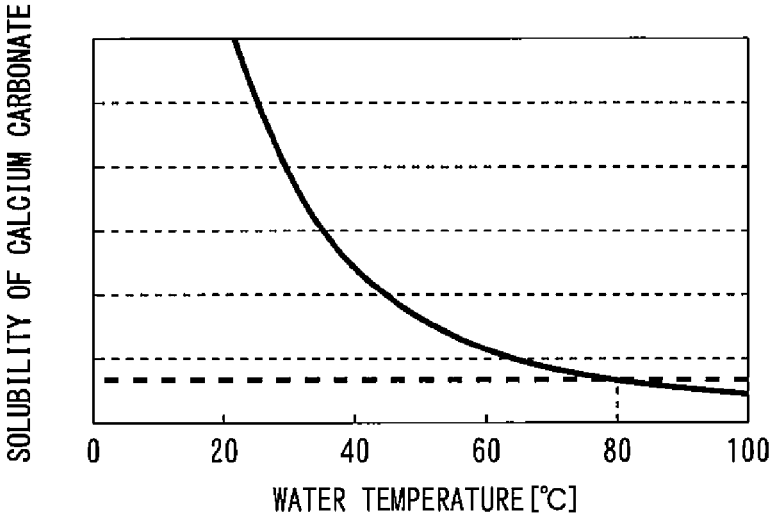
FIG. 5 is a diagram indicating a relationship between solubility of calcium carbonate in water and water temperature.

In the heat pump unit 1, deposits generally called scale adhere to a flow path inner wall because of precipitations of, e.g., calcium carbonate contained in water. FIG. 5 is a diagram indicating a relationship between solubility of calcium carbonate in water and water temperature. As indicated in FIG. 5, the solubility of calcium carbonate decreases as the water temperature increases. Thus, scale is more easily generated as the water temperature increases. In the heat pump unit 1, fed water is first heated by the second water-refrigerant heat exchanger 5 and thereby increases in temperature, and is subsequently heated by the first water-refrigerant heat exchanger 4 and thereby further increases in temperature. In other words, the temperature of the water inside the first water-refrigerant heat exchanger 4 is higher than the temperature of the water inside the second water-refrigerant heat exchanger 5. Thus, scale is easily generated inside the first water-refrigerant heat exchanger 4, and is hardly generated inside the second water-refrigerant heat exchanger 5. Therefore, even if the flow path is narrowed by accumulation of scale inside the first water-refrigerant heat exchanger 4 due to age change of the heat pump water heater according to the present embodiment, narrowing of the flow path by scale hardly occurs inside the second water-refrigerant heat exchanger 5.

In the heat pump water heater according to the present embodiment, a water-refrigerant heat exchanger is divided into the first water-refrigerant heat exchanger 4 and the second water-refrigerant heat exchanger 5, and the first water-refrigerant heat exchanger 4 and the second water-refrigerant heat exchanger 5 are separated from each other. Thus, the first water-refrigerant heat exchanger 4 alone can be replaced without replacing the second water-refrigerant heat exchanger 5. As described above, an amount of scale generated inside the second water-refrigerant heat exchanger 5 is extremely small compared to that of the first water-refrigerant heat exchanger 4. Thus, when the flow path is narrowed by accumulation of scale, the narrowing of the flow path due to scale accumulation can be overcome by replacing only the first water-refrigerant heat exchanger 4 with a new one or a recycled one without the need of replacing the second water-refrigerant heat exchanger 5. As described above, in the heat pump water heater according to the present embodiment, where scale is accumulated inside the water-refrigerant heat exchangers, it is possible to deal with the scale accumulation by replacing only the first water-refrigerant heat exchanger 4 with a new one or a recycled one without the need of replacing all of the water-refrigerant heat exchangers. Thus, maintenance can be performed easily at low cost. Note that when replacing the first water-refrigerant heat exchanger 4, it is only necessary to detach two refrigerant pipe connection parts and two water pipe connection parts from the first water-refrigerant heat exchanger 4.

Also, in the present embodiment, the first water-refrigerant heat exchanger 4 is small compared to the second water-refrigerant heat exchanger 5. Here, the first water-refrigerant heat exchanger 4 being small compared to the second water-refrigerant heat exchanger 5 means that a volume of a space occupied by the first water-refrigerant heat exchanger 4 is smaller than a volume of a space occupied by the second water-refrigerant heat exchanger 5. In the present embodiment, it is only necessary to replace the first water-refrigerant heat exchanger 4, which is relatively small, without the need of replacing the second water-refrigerant heat exchanger 5, which is relatively large, enabling maintenance to be performed more easily at lower cost.

Also, in the present embodiment, the first water-refrigerant heat exchanger 4 and the second water-refrigerant heat exchanger 5 are disposed in different chambers. Consequently, when replacing the first water-refrigerant heat exchanger 4, the second water-refrigerant heat exchanger 5 does not hinder the replacement work, and thus, the work of replacing the first water-refrigerant heat exchanger 4 can easily be performed. In particular, the first water-refrigerant heat exchanger 4 can be replaced without removing the second water-refrigerant heat exchanger 5.

Also, in the present embodiment, as a result of the first water-refrigerant heat exchanger 4 being disposed in the machine chamber 32 in which the compressor 3 is disposed, the following advantages are provided. As a first advantage, since the first water-refrigerant heat exchanger 4 can be disposed close to the compressor 3, a distance between the refrigerant paths 10 and 17 connecting the compressor 3 and the first water-refrigerant heat exchanger 4 can be shortened. Consequently, loss of pressure in the refrigerant can be reduced and loss of heat due to dissipation from the refrigerant paths 10 and 17 can be reduced, enabling performance enhancement. As a second advantage, a configuration that when replacing the first water-refrigerant heat exchanger 4, eliminates the need of removing other main devices can be provided, enabling facilitation of the work of replacing the first water-refrigerant heat exchanger 4. On the other hand, supposing that the second water-refrigerant heat exchanger 5 disposed in the ventilation chamber 33 is to be replaced, it is necessary to remove the other devices such as the blower 8, requiring a lot of trouble in the work of replacing the second water-refrigerant heat exchanger 5. Furthermore, as opposed to the ventilation chamber 33, no external air flows through the machine chamber 32, and thus the first water-refrigerant heat exchanger 4 does not need to be housed in a hard container such as the casing 34 that houses the second water-refrigerant heat exchanger 5. Therefore, as a third advantage, it is not necessary to house the first water-refrigerant heat exchanger 4 in a hard container, enabling facilitation of the work of replacing the first water-refrigerant heat exchanger 4.

Also, in the present embodiment, the second water-refrigerant heat exchanger 5 is disposed in the ventilation chamber 33 in which the evaporator 7 is disposed, enabling the ventilation chamber 33 to have a sufficiently large space. For enhancement in performance of the heat pump unit 1, it is important that the evaporator 7 is sufficiently large, and in order to make the evaporator 7 large, it is necessary to secure a large space in the ventilation chamber 33. In the present embodiment, as a result of the second water-refrigerant heat exchanger 5 being disposed in the ventilation chamber 33, a large space can be secured in the ventilation chamber 33, enabling enhancement in performance of the heat pump unit 1. On the other hand, supposing that the second water-refrigerant heat exchanger 5 is disposed in the machine chamber 32, since the second water-refrigerant heat exchanger 5 is a large-sized device, it is necessary to enlarge the machine chamber 32, and as a result, the ventilation chamber 33 needs to be reduced in size. Thus, the disadvantage of being unable to make the evaporator 7 large occurs. Also, since the second water-refrigerant heat exchanger 5 does not need to be replaced, no problems occur even though the second water-refrigerant heat exchanger 5 is disposed in a site where the second water-refrigerant heat exchanger 5 is difficult to remove such as a site below the blower 8 in the ventilation chamber 33.

In the present embodiment, it is preferable that an exit water temperature in the second water-refrigerant heat exchanger 5 during the heating operation be 80° C. or less. The thick dashed line in FIG. 5 indicates an example of an amount of calcium carbonate contained in tap water. In the case of this example, where the water temperature is approximately 80° C. or less, the contained amount of calcium carbonate is equal to or below the solubility, and thus, no calcium carbonate precipitates and no scale is generated. On the other hand, where the water temperature is approximately 80° C. or more, the contained amount of calcium carbonate exceeds the solubility, and thus, calcium carbonate precipitates and scale is generated. In view of this, setting the exit water temperature of the second water-refrigerant heat exchanger 5 to be 80° C. or less enables more reliable suppression of generation of scale in the second water-refrigerant heat exchanger 5, and also enables scale accumulation to be more reliably concentrated on the first water-refrigerant heat exchanger 4 side.

Also, in the present embodiment, it is preferable that the exit water temperature of the second water-refrigerant heat exchanger 5 during the heating operation be 65° C. or more. If the present heat pump water heater has a function that variably controls a target hot water outflow temperature, it is only necessary that the exit water temperature of the second water-refrigerant heat exchanger 5 where the target hot water outflow temperature is set to an upper limit value be 65° C. or more. As a result of setting the exit water temperature of the second water-refrigerant heat exchanger 5 to be 65° C. or more, a heating power required for the first water-refrigerant heat exchanger 4 becomes small compared to a case where the exit water temperature of the second water-refrigerant heat exchanger 5 is below 65° C., enabling downsizing of the first water-refrigerant heat exchanger 4. Thus, replacement of the first water-refrigerant heat exchanger 4 can be made easily at low cost. Also, as a result of enabling downsizing of the first water-refrigerant heat exchanger 4, the machine chamber 32 can be made small and the ventilation chamber 33 can be made large. Consequently, the evaporator 7 can be made large, enabling enhancement in performance of the heat pump unit 1. Also, a temperature of hot water stored in the hot water storage tank 2*a* in the tank unit 2 is often required to be a temperature of 65° C. or more, and thus, in general, a hot water outflow temperature of the heat pump unit 1 is also often required to be a temperature of 65° C. or more. Where the exit water temperature of the second water-refrigerant heat exchanger 5 is 65° C. or more, even if the heat exchange capability of the first water-refrigerant heat exchanger 4 is lowered because of accumulation of scale inside the first water-refrigerant heat exchanger 4, the hot water outflow temperature of the heat pump unit 1 can reliably be made to be 65° C. or more, enabling a necessary hot water outflow temperature to be secured.

Also, in the present embodiment, it is preferable that a percentage of a heating power of the first water-refrigerant heat exchanger 4 to a sum of the heating power [W] of the first water-refrigerant heat exchanger 4 and a heating power [W] of the second water-refrigerant heat exchanger 5 in the heating operation be 12% to 18%. As a result of setting the ratio between the heating power of the first water-refrigerant heat exchanger 4 and the heating power of the second water-refrigerant heat exchanger 5 as described above, the exit water temperature of the second water-refrigerant heat exchanger 5 can be made to fall within a range of roughly 65° C. to 80° C., enabling provision of effects that are similar to those described above. Also, the first water-refrigerant heat exchanger 4 can sufficiently be downsized relative to the second water-refrigerant heat exchanger 5, enabling replacement of the first water-refrigerant heat exchanger 4 to be made more easily at lower cost. Also, since the machine chamber 32 can be made to be smaller and the ventilation chamber 33 can be made to be larger, the evaporator 7 can be made to be larger, enabling further enhancement in performance of the heat pump unit 1.

Figure 6:
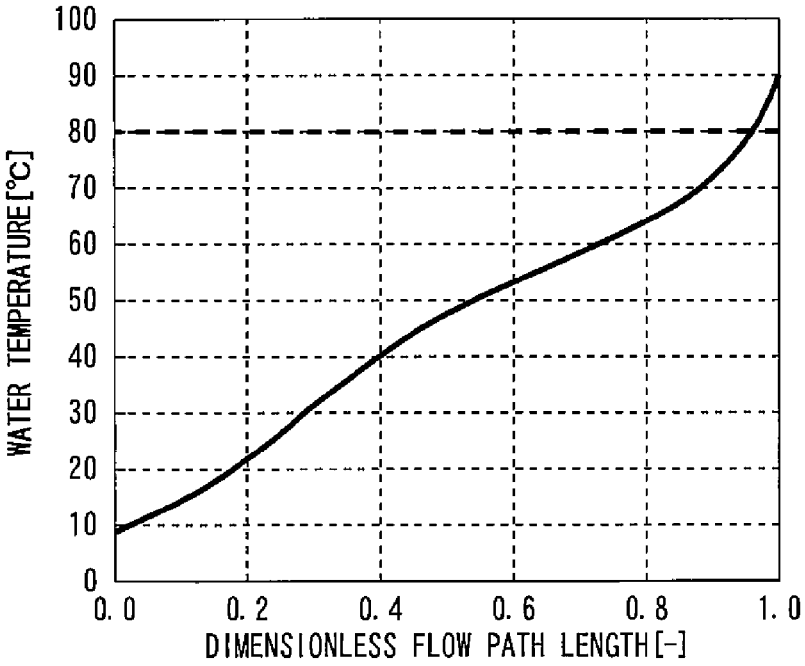
FIG. 6 is a diagram indicating a relationship between dimensionless flow path length of a water-refrigerant heat exchanger and temperature of water in the water-refrigerant heat exchanger.

FIG. 6 is a diagram indicating a relationship between dimensionless flow path length of a water-refrigerant heat exchanger and temperature of water in the water-refrigerant heat exchanger. The abscissa axis in FIG. 6 represents a dimensionless value of a length of a flow path for water (or a length of a flow path for a refrigerant) in a water-refrigerant heat exchanger, and an origin (0.0) of the abscissa axis represents a water entrance and an refrigerant exit, and a right end (1.0) of the abscissa axis represents a hot water exit and a refrigerant entrance. FIG. 6 indicates a case where a water temperature at the entrance of the water-refrigerant heat exchanger is 9° C. and a water temperature at the exit of the water-refrigerant heat exchanger is 90° C. In this case, as can be seen from FIG. 6, the water temperature reaches approximately 65° C. at a position where the dimensionless flow path length is 0.8, and the water temperature reaches approximately 80° C. at a position where the dimensionless flow path length is 0.95.

In the case of the heat pump unit 1 according to the present embodiment, the origin (0.0) of the abscissa axis in FIG. 6 corresponds to a water entrance and a refrigerant exit of the second water-refrigerant heat exchanger 5, and the right end (1.0) of the abscissa axis corresponds to a hot water exit and a refrigerant entrance of the first water-refrigerant heat exchanger 4. Where a configuration in which the first water-refrigerant heat exchanger 4 and the second water-refrigerant heat exchanger 5 have the same design of a heat-transfer part thereof and have different lengths of the water flow path (or lengths of the refrigerant flow path) therein is provided, it can be seen from FIG. 6 that a ratio between the length of the flow path in the first water-refrigerant heat exchanger 4 and the length of the flow path in the second water-refrigerant heat exchanger 5 is made to fall within a range of 0.2:0.8 to 0.05:0.95, making the exit water temperature in the second water-refrigerant heat exchanger 5 fall within the range of roughly 65° C. to 80° C.

According to the above, in the present embodiment, where a configuration in which the first water-refrigerant heat exchanger 4 and the second water-refrigerant heat exchanger 5 have the same design the heat-transfer part thereof and have different lengths of the water path (or lengths of the refrigerant flow path) therein is provided, it is preferable that the ratio between the length of the flow path in the first water-refrigerant heat exchanger 4 and the length of the flow path in the second water-refrigerant heat exchanger 5 is made to fall within the range of 0.2:0.8 to 0.05:0.95. Consequently, the exit water temperature in the second water-refrigerant heat exchanger 5 can be made to fall within the range of roughly 65° C. to 80° C., enabling provision of effects that are similar to those described above. In this case, the length of the flow path in the first water-refrigerant heat exchanger 4 is merely 5% to 20% of a total of the length of the flow path in the first water-refrigerant heat exchanger 4 and the length of the flow path in the second water-refrigerant heat exchanger 5, and thus, the first water-refrigerant heat exchanger 4 can sufficiently be downsized relative to the second water-refrigerant heat exchanger 5. Thus, replacement of the first water-refrigerant heat exchanger 4 can be made even more easily at even lower cost. Also, the machine chamber 32 can be made smaller and the ventilation chamber 33 can be made larger, and thus, the evaporator 7 can be made larger, enabling further enhancement in performance of the heat pump unit 1.

Also, even where the first water-refrigerant heat exchanger 4 and the second water-refrigerant heat exchanger 5 do not have the same design of the heat-transfer part, effects that are similar to those described above can be provided by making a ratio between an entire heat-transfer area in the first water-refrigerant heat exchanger 4 and an entire heat-transfer area in the second water-refrigerant heat exchanger 5 fall within the range of 0.2:0.8 to 0.05:0.95. Thus, in the present embodiment, it is preferable that the ratio between the entire heat-transfer area in the first water-refrigerant heat exchanger 4 and the entire heat-transfer area in the second water-refrigerant heat exchanger 5 be made to fall within the range of 0.2:0.8 to 0.05:0.95.

The heat pump water heater according to the present embodiment has a function that detects narrowing of the flow path due to scale accumulation occurs in the first water-refrigerant heat exchanger 4. Any method can be employed for determining whether or not narrowing of the flow path due to scale accumulation occurs in the first water-refrigerant heat exchanger 4, and for example, whether or not narrowing of the flow path due to scale accumulation occurs in the first water-refrigerant heat exchanger 4 can be determined by the controller 50 performing any of the following methods.

(1) A temperature difference between an exit water temperature and an entrance water temperature in the first water-refrigerant heat exchanger 4, and a temperature difference between the exit water temperature and an entrance water temperature in the second water-refrigerant heat exchanger 5 are detected by temperature sensors (not illustrated). If a ratio of the temperature difference between the exit water temperature and the entrance water temperature in the first water-refrigerant heat exchanger 4 to the temperature difference between the exit water temperature and the entrance water temperature of the second water-refrigerant heat exchanger 5 is equal to or exceeds a first determination value, the heat exchange capability of the first water-refrigerant heat exchanger 4 is normal, and thus, a determination that no narrowing of the flow path due to scale accumulation occurs in the first water-refrigerant heat exchanger 4 can be made. On the other hand, if the ratio of the temperature difference between the exit water temperature and the entrance water temperature in the first water-refrigerant heat exchanger 4 to the temperature difference between the exit water temperature and the entrance water temperature of the second water-refrigerant heat exchanger 5 is below the first determination value, the heat exchange capability of the first water-refrigerant heat exchanger 4 is lowered, and thus a determination that narrowing of the flow path due to scale accumulation occurs in the first water-refrigerant heat exchanger 4 can be made.

(2) A temperature difference between an entrance refrigerant temperature and an exit refrigerant temperature in the first water-refrigerant heat exchanger 4 is detected by a temperature sensor (not illustrated). If the temperature difference between the entrance refrigerant temperature and the exit refrigerant temperature in the first water-refrigerant heat exchanger 4 is equal to or exceeds a second determination value, the heat exchange capability of the first water-refrigerant heat exchanger 4 is normal, and thus, a determination that no narrowing of the flow path due to scale accumulation occurs in the first water-refrigerant heat exchanger 4 can be made. On the other hand, if the temperature difference between the entrance refrigerant temperature and the exit refrigerant temperature in the first water-refrigerant heat exchanger 4 is below the second determination value, the heat exchange capability of the first water-refrigerant heat exchanger 4 is lowered, and thus, a determination that narrowing of the flow path due to scale accumulation occurs in the first water-refrigerant heat exchanger 4 can be made.

(3) The rotation speed of the water pump **2*b* is controlled by the controller 50, and if a resistance of the water circuit increases as a result of narrowing of the flow path due to scale accumulation in the first water-refrigerant heat exchanger 4, in order to secure a necessary water flow rate, the rotation speed of the water pump 2*b* is corrected so as to increase the rotation speed. Thus, upon narrowing of the flow path due to scale accumulation in the first water-refrigerant heat exchanger 4, the rotation speed of the water pump 2*b* becomes higher compared to that of a normal case. Therefore, if the rotation speed of the water pump 2*b* exceeds a third determination value, a determination that narrowing of the flow path due to scale accumulation occurs in first water-refrigerant heat exchanger 4 can be made. On the other hand, if the rotation speed of the water pump 2*b* is equal to or below the third determination value, a determination that no narrowing of the flow path due to scale accumulation occurs in first water-refrigerant heat exchanger 4** can be made.

If the controller 50 detects that narrowing of the flow path due to scale accumulation occurs in the first water-refrigerant heat exchanger 4, it is desirable to inform a user of the abnormality by providing an indication on a display included in the user interface device (not illustrated) or providing a voice from a speaker included in the user interface device. Consequently, it is possible to urge the user to do maintenance.

If the controller 50 detects that narrowing of the flow path due to scale accumulation occurs in the first water-refrigerant heat exchanger 4, the subsequent heating operation may be halted. However, if the heating operation is halted without prior notice, no heating operation can be performed until maintenance of the first water-refrigerant heat exchanger 4 is performed, which may hinder convenience for users. Therefore, in the present embodiment, even if the controller 50 detects that narrowing of the flow path due to scale accumulation occurs in the first water-refrigerant heat exchanger 4, the controller 50 continues the subsequent heating operation. Consequently, the heating operation can be performed even during the time until the maintenance of the first water-refrigerant heat exchanger 4 is performed, enabling enhancement in convenience for users.

If the controller 50 continues the heating operation even after detection of narrowing of the flow path due to scale accumulation in the first water-refrigerant heat exchanger 4, it is preferable that the controller 50 perform control so as to make the hot water outflow temperature be low compared to a case where no narrowing of the flow path is detected. For example, if the controller 50 detects that narrowing of the flow path due to scale accumulation occurs in the first water-refrigerant heat exchanger 4, the target hot water outflow temperature is set to be a low value (for example, 65° C.) compared to a target hot water outflow temperature (for example, 90° C.) in normal cases where no narrowing of the flow path is detected. As described above, when the heating operation is continued after detection of narrowing of the flow path due to scale accumulation in the first water-refrigerant heat exchanger 4, calcium precipitation can be suppressed by decreasing the hot water outflow temperature, enabling reliable suppression of increase of scale in the first water-refrigerant heat exchanger 4. Thus, a failure to perform the heating operation due to occlusion of the flow path in the first water-refrigerant heat exchanger 4 by scale before maintenance of the first water-refrigerant heat exchanger 4 is performed can reliably be avoided.

Also, if the controller 50 continues the heating operation even after detection of narrowing of the flow path due to scale accumulation in the first water-refrigerant heat exchanger 4, it is preferable that the controller 50 perform control so that the temperature of the refrigerant discharged from the first outlet 3*e* of the compressor 3 is low compared to that of a case where no narrowing of the flow path is detected. The controller 50 can control the temperature of the refrigerant discharged from the first outlet 3*e* of the compressor 3 by controlling the expansion valve 6. If the temperature of the refrigerant discharged from the first outlet 3*e* of the compressor 3 is high, water heated by the refrigerant has a high temperature locally or temporarily, which may cause calcium precipitation. Therefore, when the heating operation is continued after detection of narrowing of the flow path due to scale accumulation in the first water-refrigerant heat exchanger 4, the temperature of the refrigerant discharged from the first outlet 3*e* of the compressor 3 is made to be low, whereby water heated by the refrigerant can be prevented from having a high temperature locally or temporarily, enabling more reliable suppression of calcium precipitation. As a result, an increase of scale in the first water-refrigerant heat exchanger 4 can reliably be suppressed. Thus, a failure to perform the heating operation due to occlusion of the flow path in the first water-refrigerant heat exchanger 4 by scale before maintenance of the first water-refrigerant heat exchanger 4 is performed can reliably be avoided.

Although an embodiment of the present invention has been described above, the present invention is not limited to the above embodiment. For example, although the above embodiment has been described in terms of a case where the compressor 3 including the first inlet 3*d*, the first outlet 3*e*, the second inlet 3*f* and the second outlet 3*g* is used, the present invention can be applied to a refrigerant circuit in which a compressor including one inlet and one outlet and a refrigerant that has passed through the first water-refrigerant heat exchanger 4 is sent to the second water-refrigerant heat exchanger 5 without passing through the compressor.

REFERENCE SIGNS LIST

1 heat pump unit
1*a* water entrance port
1*b* hot water exit port
2 tank unit
2*a* hot water storage tank
2*b* water pump
2*c* hot water supply mixing valve
3 compressor
3*a* sealed container
3*b* compression element
3*c* motor element
3*d* first inlet
3*e* first outlet
3*f* second inlet
3*g* second outlet
4 first water-refrigerant heat exchanger
5 second water-refrigerant heat exchanger
6 expansion valve
7 evaporator
8 blower
9 high-low pressure heat exchanger
11, 12 water pipe
13 feed-water pipe
14 hot water outflow pipe
15 water supply branch pipe
16 hot water supply pipe
10, 17, 18, 19, 20, 21 refrigerant path
23, 24, 26 water channel
30 housing
31 partition member
32 machine chamber
33 ventilation chamber
34 casing
50 controller

The invention claimed is:

1. A heat pump water heater comprising:

a compressor configured to compress a refrigerant;

a first water-refrigerant heat exchanger configured to exchange heat between the refrigerant and water;

a second water-refrigerant heat exchanger configured to exchange heat between the refrigerant and water;

refrigerant paths capable of forming a refrigerant circuit, the refrigerant circuit supplying the refrigerant compressed by the compressor to the first water-refrigerant heat exchanger, the refrigerant circuit supplying the refrigerant that has passed through the first water-refrigerant heat exchanger to the second water-refrigerant heat exchanger; and water channels including a flow channel, the flow channel leading hot water that has passed through the second water-refrigerant heat exchanger to the first water-refrigerant heat exchanger, the heat pump water heater being able to perform a heating operation, the hot water heated in the second water-refrigerant heat exchanger being fed to the first water-refrigerant heat exchanger in the heating operation, the hot water further heated in the first water-refrigerant heat exchanger being supplied to a downstream side of the water channels in the heating operation, the first water-refrigerant heat exchanger being able to be replaced without replacing the second water-refrigerant heat exchanger, the compressor including a first inlet from which the refrigerant is drawn in, a first outlet from which the refrigerant drawn in from the first inlet is discharged, a second inlet from which the refrigerant is drawn in, and a second outlet from which the refrigerant drawn in from the second inlet is discharged, the refrigerant paths including a path that leads the refrigerant discharged from the first outlet to the first water-refrigerant heat exchanger, a path that leads the refrigerant that has passed through the first water-refrigerant heat exchanger to the second inlet, and a path that leads the refrigerant discharged from the second outlet to the second water-refrigerant heat exchanger.

2. The heat pump water heater according to claim 1, wherein the first water-refrigerant heat exchanger is small compared to the second water-refrigerant heat exchanger.

3. The heat pump water heater according to claim 1, wherein an exit water temperature in the second water-refrigerant heat exchanger during the heating operation is 80° C. or less.

4. The heat pump water heater according to claim 1, wherein an exit water temperature in the second water-refrigerant heat exchanger during the heating operation is 65° C. or more.

5. The heat pump water heater according to claim 1, wherein, in the heating operation, a percentage of a heating power of the first water-refrigerant heat exchanger to a sum of the heating power of the first water-refrigerant heat exchanger and a heating power of the second water-refrigerant heat exchanger is 12% to 18%.

6. The heat pump water heater according to claim 1, wherein the first water-refrigerant heat exchanger and the second water-refrigerant heat exchanger have the same design of a heat-transfer part and have different lengths of an interior flow path; and wherein a ratio between a length of the flow path in the first water-refrigerant heat exchanger and a length of the flow path in the second water-refrigerant heat exchanger is 0.2:0.8 to 0.05:0.95.

7. The heat pump water heater according to claim 1, wherein a ratio between an entire heat-transfer area in the first water-refrigerant heat exchanger and an entire heat-transfer area in the second water-refrigerant heat exchanger is 0.2:0.8 to 0.05:0.95.

8. The heat pump water heater according to claim 1, wherein the compressor includes, in a sealed container, a compression element configured to compress the refrigerant, and a motor element configured to drive the compression element;

wherein the refrigerant drawn in from the first inlet is compressed by the compression element and then discharged from the first outlet; and wherein the refrigerant drawn in from the second inlet cools the motor element and is then discharged from the second outlet.

9. The heat pump water heater according to any one of claim 1, wherein the first water-refrigerant heat exchanger is disposed inside a chamber in which the compressor is disposed.

10. The heat pump water heater according to claim 1, wherein the second water-refrigerant heat exchanger is disposed inside a chamber in which an evaporator configured to evaporate the refrigerant is disposed.

11. The heat pump water heater according to claim 1, comprising:

a flow path narrowing detector to detect that flow path narrowing by a deposit precipitated from the hot water occurs in the first water-refrigerant heat exchanger; and a user interface, if it is detected that the flow path narrowing occurs, to inform about an abnormality.

12. The heat pump water heater according to claim 1, comprising:

a flow path narrowing detector to detect that flow path narrowing by a deposit precipitated from the hot water occurs in the first water-refrigerant heat exchanger; and a controller, if it is detected that the flow path narrowing occurs, to decrease a temperature of the hot water supplied to the downstream side in the heating operation, compared to a case where the flow path narrowing is not detected.

13. The heat pump water heater according to claim 1, comprising:

a flow path narrowing detector to detect that flow path narrowing by a deposit precipitated from the hot water occurs in the first water-refrigerant heat exchanger; and a controller, if it is detected that the flow path narrowing occurs, to decrease a temperature of the refrigerant discharged from the compressor compared to a case where the flow path narrowing is not detected.

14. The heat pump water heater according to claim 1, wherein a pressure on a high-pressure side of the refrigerant is a pressure exceeding a critical pressure.

15. A heat pump water heater comprising:

a compressor configured to compress a refrigerant;

a first water-refrigerant heat exchanger configured to exchange heat between the refrigerant and water;

a second water-refrigerant heat exchanger configured to exchange heat between the refrigerant and water;

refrigerant paths capable of forming a refrigerant circuit, the refrigerant circuit supplying the refrigerant compressed by the compressor to the first water-refrigerant heat exchanger, the refrigerant circuit supplying the refrigerant that has passed through the first water-refrigerant heat exchanger to the second water-refrigerant heat exchanger;

water channels including a flow channel, the flow channel leading hot water that has passed through the second water-refrigerant heat exchanger to the first water-refrigerant heat exchanger; and a plurality of chambers, the heat pump water heater being able to perform a heating operation, the hot water heated in the second water-refrigerant heat exchanger being fed to the first water-refrigerant heat exchanger in the heating operation, the hot water further heated in the first water-refrigerant heat exchanger being supplied to a downstream side of the water channels in the heating operation, the first water-refrigerant heat exchanger being able to be replaced without replacing the second water-refrigerant heat exchanger, the first water-refrigerant heat exchanger and the second water-refrigerant heat exchanger being disposed in different ones of the chambers.

16. The heat pump water heater according to claim 15, wherein the first water-refrigerant heat exchanger is small compared to the second water-refrigerant heat exchanger.

17. The heat pump water heater according to claim 15, wherein an exit water temperature in the second water-refrigerant heat exchanger during the heating operation is 80° C. or less.

18. The heat pump water heater according to claim 15, wherein an exit water temperature in the second water-refrigerant heat exchanger during the heating operation is 65° C. or more.

19. The heat pump water heater according to claim 15, wherein, in the heating operation, a percentage of a heating power of the first water-refrigerant heat exchanger to a sum of the heating power of the first water-refrigerant heat exchanger and a heating power of the second water-refrigerant heat exchanger is 12% to 18%.

20. The heat pump water heater according to claim 15, wherein the first water-refrigerant heat exchanger and the second water-refrigerant heat exchanger have the same design of a heat-transfer part and have different lengths of an interior flow path; and wherein a ratio between a length of the flow path in the first water-refrigerant heat exchanger and a length of the flow path in the second water-refrigerant heat exchanger is 0.2:0.8 to 0.05:0.95.

21. The heat pump water heater according to claim 15, wherein a ratio between an entire heat-transfer area in the first water-refrigerant heat exchanger and an entire heat-transfer area in the second water-refrigerant heat exchanger is 0.2:0.8 to 0.05:0.95.

22. The heat pump water heater according to any one of claim 15, wherein the first water-refrigerant heat exchanger is disposed inside a chamber in which the compressor is disposed.

23. The heat pump water heater according to claim 15, wherein the second water-refrigerant heat exchanger is disposed inside a chamber in which an evaporator configured to evaporate the refrigerant is disposed.

24. The heat pump water heater according to claim 15, comprising:

a flow path narrowing detector to detect that flow path narrowing by a deposit precipitated from the hot water occurs in the first water-refrigerant heat exchanger; and a user interface, if it is detected that the flow path narrowing occurs, to inform about an abnormality.

25. The heat pump water heater according to claim 15, comprising:

a flow path narrowing detector to detect that flow path narrowing by a deposit precipitated from the hot water occurs in the first water-refrigerant heat exchanger; and a controller, if it is detected that the flow path narrowing occurs, to decrease a temperature of the hot water supplied to the downstream side in the heating operation, compared to a case where the flow path narrowing is not detected.

26. The heat pump water heater according to claim 15, comprising:

a flow path narrowing detector to detect that flow path narrowing by a deposit precipitated from the hot water occurs in the first water-refrigerant heat exchanger; and a controller, if it is detected that the flow path narrowing occurs, to decrease a temperature of the refrigerant discharged from the compressor compared to a case where the flow path narrowing is not detected.

27. The heat pump water heater according to claim 15, wherein a pressure on a high-pressure side of the refrigerant is a pressure exceeding a critical pressure.

* * * * *